United States Patent [19]

Norberg et al.

[11] 4,289,098

[45] Sep. 15, 1981

[54] DEVICE FOR CONTROLLING PRELIMINARY INJECTION

[75] Inventors: Helmut Norberg, Stuttgart; Richard Kinzel, Bensheim, both of Fed. Rep. of Germany

[73] Assignee: Robert Bosch GmbH, Stuttgart, Fed. Rep. of Germany

[21] Appl. No.: 62,596

[22] Filed: Jul. 31, 1979

[30] Foreign Application Priority Data

Aug. 8, 1978 [DE] Fed. Rep. of Germany ..... 2834633

[51] Int. Cl.[3] ..... F02M 45/04

[52] U.S. Cl. ..... 123/299; 123/300; 123/460; 239/533.4

[58] Field of Search ..... 123/32 G, 139 DP, 139 AT, 123/299, 300, 460, 462; 239/533.4, 533.5, 533.7

[56] References Cited

U.S. PATENT DOCUMENTS 2,813,752 11/1957 Pringham ..... 123/32 G 3,394,891 7/1968 Voit ..... 123/32 G 3,438,359 4/1969 Thoma ..... 123/32 G 3,627,208 12/1971 Scott ..... 123/32 G

FOREIGN PATENT DOCUMENTS 810456 3/1959 United Kingdom ..... 123/32 G

*Primary Examiner*—Charles J. Myhre

*Assistant Examiner*—Carl Stuart Miller

*Attorney, Agent, or Firm*—Edwin E. Greigg

[57] ABSTRACT

The invention relates to a fuel injection system with a device for controlling the preliminary and principal injections wherein control is effected by intermediate relief of the injection pressure which includes a slide valve for exerting the control which is braked during its reverse movement before interrupting the connection between the pressure chamber of the injection nozzle and the delivery line leading to the injection pump to thereby make possible the relief of the pressure chamber toward the injection pump, i.e. to avoid dribbling.

4 Claims, 7 Drawing Figures

DEVICE FOR CONTROLLING PRELIMINARY INJECTION

BACKGROUND OF THE INVENTION

In a conventional device of this type to which the invention is directed, the control slide valve driven by the pressure of the reservoir, enters its starting position in which it interrupts the direct communication between the pressure chamber of the fuel injection nozzle and the feed line leading to the injection pump relatively quickly, so that too little time is available for the required pressure relief of the pressure chamber of the nozzle toward the injection pump. This leads to dribbling with a consequent impairment of the exhaust gas and a gumming up of the nozzle injection orifices with carbon.

OBJECT AND SUMMARY OF THE INVENTION

The device of this invention has the advantage, in contrast to that of the prior art, in that by blocking the communication between the relief line and the working chamber, the control slide valve is not additionally driven by the reservoir pressure, but rather is braked by the pressure of the return flow of fuel ambient in the feed line. This makes it possible to relieve the pressure chamber of the injection nozzle toward the pump, thus avoiding dribble.

The invention will be better understood as well as further objects and advantages thereof become more apparent from the ensuing detailed description of preferred embodiments taken in conjunction with the drawings.

BRIEF DESCRIPTION OF THE DRAWINGS

One embodiment of the present invention is shown in a simplified illustration in the drawings and will be explained in greater detail hereinbelow. In the drawings.

DESCRIPTION OF THE EMBODIMENT

Figure 1:
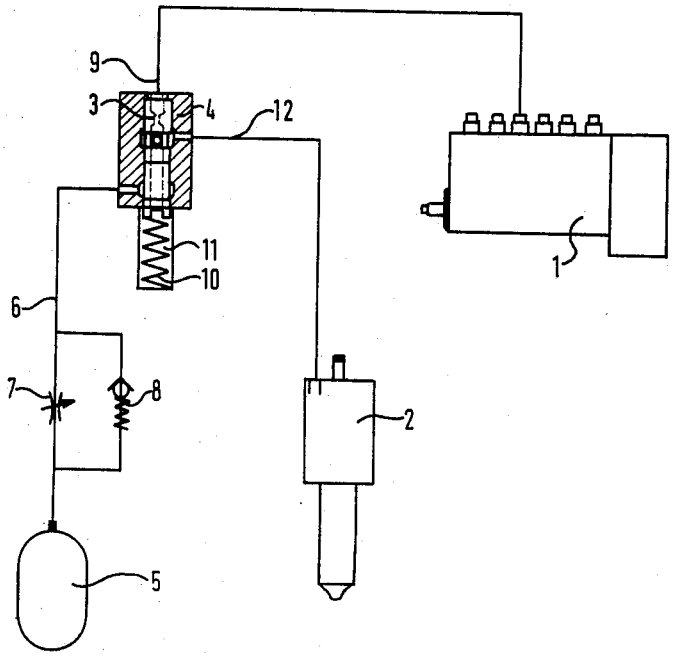
FIG. 1 is a schematic illustration of a fuel injection system incorporating the device of the invention.

In the injection system illustrated in FIG. 1, a device 4 operating with a control slide valve 3 is arranged between an injection pump 1 and each of the injection nozzles 2 of the system, only one being shown in FIG. 1. The device 4 effects a preliminary injection and a principal injection by intermediate relief during the injection process. The intermediate relief is effective into a reservoir 5. Arranged in a relief line 6 between the device 4 and the reservoir 5 are a throttle point 7 and, in parallel thereto, a check valve 8 opening toward the reservoir 5.

When the fuel is fed under pressure via a feed line 9 from the injection pump 1 to the device 4, the control slide valve 3 is displaced against a resetting spring 10 into a working chamber 11. During this step, fuel is displaced from the working chamber 11 via a delivery line 12 to the injection nozzle 2. After the control slide valve 3 has traversed a so-called preliminary injection stroke, the control slide valve 3 places the relief line 6 into an open position and blocks the pressure line 12, and after a further stroke establishes, via the rearward end of the control slide valve 3, a direct communication between the feed line 9 and the delivery line 12.

The reverse movement of the control slide valve 3 is temporarily braked, as long as this direct communication exists, to thereby make possible a relief of the pressure chamber of the injection nozzle 2 via the conduits 9 and 12 toward the injection pump 1.

FIGS. 2–7 show the device 4 and the control slide valve 3 in partial and enlarged views to explain the control function in greater detail.

Figures 2, 3, 4, 5, 6, 7:
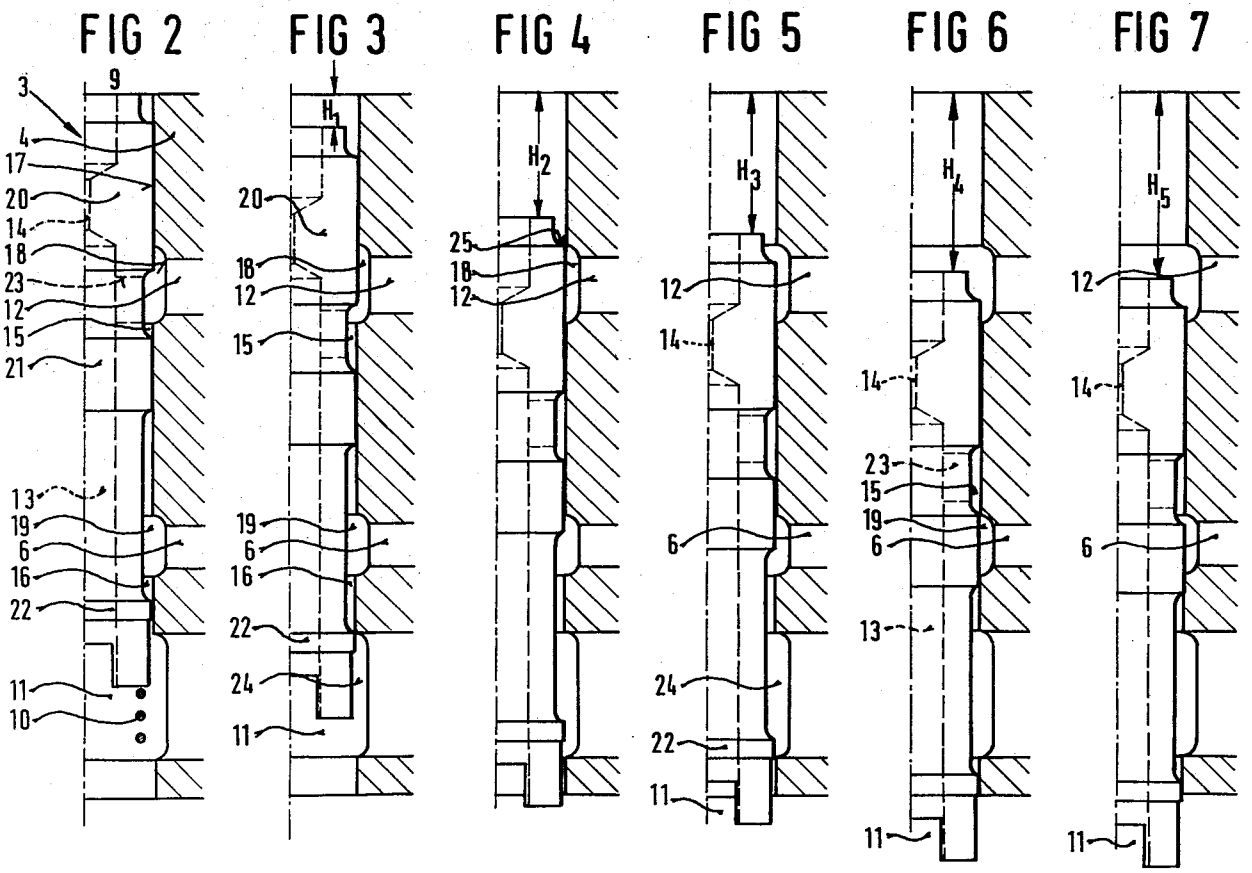
FIG. 2 is a longitudinal sectional view of the control slide valve of the injection in one control position.
FIG. 3 is a view similar to FIG. 2 showing the valve in another control position.
FIG. 4 is a view similar to FIG. 2 showing the valve in a further control position.
FIG. 5 is a view similar to FIG. 2 showing the valve in still another control position.
FIG. 6 is a view similar to FIG. 2 showing the valve in a still further control position.
FIG. 7 is a view similar to FIG. 2 showing the valve in still another control position.

FIG. 2 shows the control slide valve 3 in its rest position. The control slide valve 3 has a central bore 13 provided with a throttle 14 toward the feed line 9. On the outer surface of the control slide valve 3, two annular grooves are arranged, of which the narrower annular groove 15, in the illustrated position, is adjacent to the delivery line 12 and the wider annular groove 16 is adjacent to the relief line 6.

To obtain favorable overlapping for control purposes, annular grooves 18 and 19 are provided in the bore 17 of the device 4 receiving the slide valve 3, the delivery line 12 and the relief line 6, terminating in these annular grooves 18, 19, respectively. The ends of the control slide valve 3 are machined so that between these machined sections and the annular grooves 15 and 16, as seen from the feed line 9, three control shoulders 20, 21 and 22 are produced. Since the central bore 13 of the control slide valve 3 terminates without throttling into the working chamber 11 of the device 4, a connection without throttling exists in the starting position shown in FIG. 2 between the working chamber 11 via the delivery line 12 with the pressure chamber of the injection nozzle 2. In contrast thereto, the relief line 6 is separated from the working chamber 11 by the shoulder 22.

As soon as the pressure stroke of the injection pump 1 commences, the control slide valve 3 is displaced against the force of the spring 10 into the working chamber 11, since the throttle 14, due to its very narrow cross section as related to the feed rate and time, acts like a barrier. The amount of fuel displaced during this shifting step is conveyed via the central bore 13, a radial bore 23 of the control slide valve 3, the annular grooves 15 and 18, and the delivery line 12, to the injection pump 1, where it is injected as the preliminary injection quantity.

After exceeding the stroke $H_1$ (shown in FIG. 3) the shouler 22 of the control slide valve 3 engages an annular groove 24 in the guide bore 17. This takes place before the annular groove 18, i.e., the delivery line 12, is separated by the shoulder 20 of the control slide valve 3 from the working chamber 11. When the stroke $H_1$ is exceeded, a connection is then established first from the working chamber 11, via the annular grooves 24, 16 and 19, to the relief duct 6 and thus to the reservoir 5. Shortly thereafter, the communication between the working chamber 11 and the delivery line 12 via the annular grooves 15 and 18 is interrupted, i.e. preliminary injection is terminated.

After traversing the stroke $H_2$, the top control edge 25 of the slide valve 3, as shown in FIG. 4, uncovers the annular groove 18 toward the delivery line 12. Shortly after traversing the entire stroke $H_3$ (shown in FIG. 5) the shoulder 22 of the control slide valve 3 separates the working chamber 11 from the relief line 6 and the reservoir 5, respectively. For this purpose, the shoulder 22 again engages the bore 17.

After traversing the stroke $H_2$, therefore, the principal injection commences, for which a direct communication is established between the feed line 9 and the delivery line 12, as shown in FIG. 5. Since the communication between the working chamber 11 and the relief line 6 is blocked starting with stroke $H_3$, the further stroke movement of the slide valve 3 during the principal injection takes place under braking, since the fuel displaced by the slide valve 3 from the working chamber 11 must flow via the throttle 14.

Once the control slide valve 3 moves past the entire stroke $H_4$, as shown in FIG. 6, the annular groove 15 is congruent with the annular groove 19, so that there is again a communication between the working chamber 11 and the relief duct 6 via the central bore 13, the radial bore 23, and the annular grooves 15, 19. As shown in FIG. 7, after traversing the entire stroke $H_5$, the control slide valve 3 then assumes its final position, wherein there is communication between the feed line 9 and the delivery line 12, as well as between the working chamber 11 and the relief line 6. The reservoir 5 is fully charged by way of the throttle 14.

After termination of injection, the control slide valve 3, urged by the high pressure in the reservoir 5, returns relatively quickly to stroke $H_4$. Since, as can be seen from FIG. 6, the relief line 6, i.e. the reservoir 5, is thereafter separated from the chamber 11, only the spring 10 is effective in the reversal direction. However, since the throttle 14 permits fuel flow from the feed line 9 and/or delivery line 12 into the working chamber 11 only to a slight extent, the more so since the pressure effective on the side of the feed line is relatively weak, the control slide valve 3 is braked until the stroke $H_3$ is reached. This affords the possibility of pressure relief for the pressure chamber of the injection nozzle 2 via the delivery line 12 and the feed line 9 toward the injection pump 1, avoiding dribbling with the known disadvantages. The further reverse movement of the control slide valve 3 then takes place without throttling except for the residual stroke $H_1$. During this step, the working chamber 11 is recharged by reservoir 5 via the throttle 7. This throttle 7 is preferably adjustable, so that this residual reversing speed can also be influenced.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A device for controlling the preliminary injection by intermediate relief for internal combustion engines including an injection pump, an injection nozzle, a housing having a uniform inner bore and a control slide valve slidable within said uniform housing bore, said control slide valve including a central bore, and upper, middle, and lower shoulders thereon, said shoulders forming a narrow central annular groove and a wider lower annular groove, said central bore including an axially aligned throttle directly opposite said upper shoulder thereon; said housing including an upper annular groove and a lower annular groove; a feed line connecting with said uniform bore in said housing for feeding fuel between said injection pump and said uniform inner bore, a spring for urging said control slide valve into a rest position, said control slide valve being displaceable from said rest position against the force of said spring by the fuel fed from said injection pump via said feed line to said uniform housing bore, a delivery line connecting with said upper annular groove in said housing for feeding fuel between said upper housing bore and said injection nozzle, a working chamber disposed upstream of said control slide valve, a fuel reservoir, a relief line connecting with said lower annular groove in said housing for feeding fuel between said lower housing bore and said reservoir, said control slide valve including means for displacing, during a first portion of a sliding movement of said control slide valve from said rest position, a preliminary injection quantity of fuel from said working chamber through said central bore in said control slide valve into said delivery line, said lower annular groove on said control slide opening-up said relief line in order to terminate said preliminary injection, said upper shoulder on said control slide valve closing the passage between said working chamber and said delivery line, said control slide valve including means for connecting said feed line directly with said delivery line, during a second portion of said sliding movement of said control slide valve, for purposes of principal injection, characterized in that said middle shoulder on said control slide valve closes-off temporarily the passage between said relief line and said working chamber so that said control slide valve is isolated from reservoir pressure and is thereby braked until the passage between said relief line and said working chamber is re-established before again interrupting the direct passage between said delivery line and said feed line during the return movement of said control slide valve to said rest position.

2. A device according to claim 1, wherein said injection nozzle includes a housing and wherein said control slide valve and said working chamber are arranged directly within the said nozzle housing of nozzle.

3. A device in accordance with claim 1 including a stop for defining an end position of said control slide valve and wherein in said end position of said control slide valve the passage between said working chamber and said relief line is re-established.

4. A device in accordance with claim 1 wherein said annular grooves arranged in the outer surface of the control slide valve and said housing inner bore are arranged for fuel flow control, said annular grooves are disposed for overlapping in a predetermined sequence during said sliding movement of the control slide valve.

* * * * *